United States Patent [19]

Ess

[11] 4,187,796

[45] Feb. 12, 1980

[54] SPECIFIC GRAVITY EQUALIZER SYSTEM

[75] Inventor: John O. Ess, Alexandria, Va.

[73] Assignee: The United States of America as represented by the Secretary of the Navy, Washington, D.C.

[21] Appl. No.: 865,752

[22] Filed: Dec. 29, 1977

Related U.S. Application Data

[63] Continuation-in-part of Ser. No. 591,210, Jun. 27, 1975, abandoned.

[51] Int. Cl.[2] ..... B63G 8/00

[52] U.S. Cl. ..... 114/312; 114/333; 405/193

[58] Field of Search ..... 114/312, 333, 331; 61/69 R; 405/185, 193; 92/130 A, 208

[56] References Cited

U.S. PATENT DOCUMENTS

| | | | |
|---|---|---|---|
| 1,090,162 | 3/1914 | Meyer et al. | 92/208 X |
| 3,066,324 | 12/1962 | Snyder et al. | 114/331 X |
| 3,102,504 | 9/1963 | Sato | 114/333 X |
| 3,555,834 | 1/1971 | Weston, Jr. | 114/312 X |

*Primary Examiner*—Sherman D. Basinger
*Attorney, Agent, or Firm*—R. S. Sciascia; Philip Schneider; Melvin L. Crane

[57] ABSTRACT

A system for varying specific gravity of a submersible or any immersed object under a pressurized environment which includes a compressible piston designed to collapse a certain amount proportional to the submersible's depth so that the specific gravity of the submersible or other immersed object varies and remains almost equal to the specific gravity of the surrounding medium such as water.

11 Claims, 5 Drawing Figures

SPECIFIC GRAVITY EQUALIZER SYSTEM

CROSS REFERENCE TO RELATED PATENT APPLICATION

This application is a continuation-in-part of patent application Ser. No. 591,210 filed June 27, 1975, now abandoned.

BACKGROUND OF THE INVENTION

This invention relates to submersible vessels such as immersed submarines and more particularly to an automatic specific gravity compensation system for a submersible vessel or object.

The invention may be used with any vessel or object which is immersed in a fluid medium, but will be described in particular for use with a submersible vessel such as ocean research vessels which have some motive power and which may operate at very great depths in water.

It is well known that once submerged, the specific gravity of a vessel changes due to density changes of the surrounding ocean or to volume changes caused by either elastic strain or thermal deformation of the pressure hull or of any auxiliary flotation materials.

Water density, the change of which is mostly due to compressibility, is a function of operating depth. Volume changes of pressure hulls in general vary linearly with depth as most engineering materials are used in the region below their proportional limit. Most flotation materials, however, are similar to water and have a Bulk Modulus which increases somewhat with pressure allowing for smaller volume changes for the same increment of pressure at the higher pressures.

For typical design stresses, the metallic pressure hull of a submersible is from two to three times as stiff as the surrounding water. Auxiliary flotation materials such as syntactic foam have the same order of stiffness. Other materials such as solid glass can be highly stressed so that their volume changes may be made somewhat equal to or greater than water. Most liquid flotation materials are more compressible than water.

An ideally designed submersible has a specific gravity which will change proportionately the same as the surrounding ocean water when diving. This may be accomplished with a judicious selection of materials but a the expense of having a vehicle which may either be inefficiently designed or functionally inferior. Up until the present, a typical deep diving submersible contained either a pressure hull alone for flotation, or a combination of pressure hull and some other solid or liquid material for flotation. If the pressure hull or the combination pressure hull and solid material are used for flotation, some ballasting system has to be used to remove the additional buoyancy the submersible gets on going to the ocean bottom. In general, the system uses flooding tanks or tanks where a liquid lighter than water is released and replaced by sea water. After completing an operation in the deep ocean some weight is released to get back the buoyancy required to ascend to the surface. As an example, for the submersible ALUMINAUT to ascent from a working depth of 15,000 ft. approximately 4500 lbs of steel shot are dropped. For all vehicles, if the depth variation is required while working near the ocean bottom additional ballasting is required.

If a liquid flotation system is used, the process is reversed. Shot is dropped to remain slightly negatively buoyant while descending to a working depth. To surface, a slight additional amount of shot is released to obtain a slight positive buoyance. The submersible then gains additional buoyancy upon rising due to the greater than sea-water expansion of the flotation fluid. Again, if depth variation is wanted additional shot is required. In general, much more shot is required for a vehicle of this type due to its larger displacement to support a given payload.

A number of different schemes for varying specific gravity have been considered. For shallow and medium depths stored air systems have proven advantageous. For higher pressures, some sort of pumping system is required. To pump against a high pressure head, takes considerable energy. It is estimated that at a 20,000 ft. depth it would take a pound of batteries to pump 3 or 4 lbs of water, to say nothing of the equipment required. One such system is set forth in U.S. Pat. No. 3,665,884 which makes use of a hydraulic pump, storage accumulator system which controls water ballast storage.

SUMMARY OF THE INVENTION

This invention is directed to a compressible means which is attached to or within the body of a submersible vessel or other immersed system and acts upon by the surrounding medium. The compressible means is designed to collapse i.e., compress in volume, an amount proportional to the depth of the submersible in the surrounding medium so that the specific gravity of the submersible varies and remains substantially equal to the specific gravity of the surrounding medium at the prevailing depth. Thus, control of the system specific gravity is achieved by the variation in volume relative to the surrounding medium with depth. Different compressible means may be used, each of which compress a particular pressure increment; therefore, different compressible means may be compressed at different depths in the medium to account for the different pressure levels at the different depths. Compressible means may take different forms and operate to control the specific gravity of the submersible vessel. These may be a block of rubber or other material, or a container made of extensible material with a compressible material therein, such as rubber, gasoline, air, or any other material that has suitable elasticity. The compressible means may be a stationary casing with a movable enclosure backed by a spring aided by a fluid such as air in the area within the casing. The disc spring aided by fluid in the casing reacts against the surrounding medium pressure to control the movement of the movable enclosure into the casing thereby controlling the amount of surrounding medium contained in the displaced area of the movable enclosure. The amount of water therein serves to vary the specific gravity of the submersible vessel. The fluid backing reduces the load on the spring at high pressures. Since the volume of fluid backing is finite, the force on the movable enclosure is not proportional to displacement when considering the fluid as spring alone. To compensate for this varying fluid force disc springs with different thickness may be used so that movable enclosure displaces approximately linearly over the incremental pressure range that the unit operates when the surrounding medium presses in and it is counteracted by the disc springs or by the combination of disc springs and fluid backing. The height to thickness ratio of a disc spring determines its stiffness coefficient or spring varying rate and thereby its load-carrying capability. A plurality of such casing-movable enclosure assemblies with different fluid backing pressures with springs with different spring varying rates may be built into a system to provide control over the entire depth range of operation or the entire range of pressure. The movable enclosures are automatically forced in or out as the unit reaches the different pressure levels of operation during descend and ascent. The surrounding medium forces itself and the movable enclosure in during descent and the movable enclosure backed by the spring-fluid backing-forces the medium out during ascent. Thus, the specific gravity of the submersible vessel remains substantially equal to the specific gravity of the surrounding medium.

DETAILED DESCRIPTION

Figure 1:
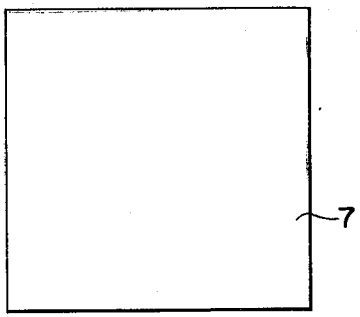
FIG. 1 illustrates a compressible means.

FIG. 1 is a compressible means such as a block of rubber or some other compressible material which may be attached to the outside of a submersible vessel or any other immersible object under a pressurized environment. Compressible means may be placed within the body of the submersible vessel with an opening to the surrounding medium so that the compressible means will be subjected to the pressure of the surrounding medium. One or more such compressible means may be so assembled and may be provided with different collapse rates which are proportional to the submersibles' depth in the surrounding medium so that the specific gravity of the submersible varies and remains substantially equal to the specific gravity of the surrounding medium.

Figure 2:
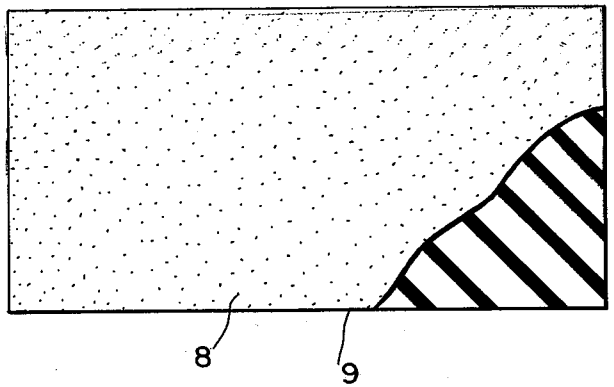
FIG. 2 illustrates an extensible material container with a compressible means therein.

FIG. 2 illustrates a compressible means 8 within an extensible container 9 wherein the surrounding medium will apply pressure forces to the compressible means within the extensible container. The compressible means within the container may be a compressible rubber, gasoline, a suitable fluid, air, etc. The compressible means shown in FIGS. 1 and 2 may be attached to the outside or supported within the body of a submersible. The compressible means will collapse an amount proportional to the submersible's depth in the surrounding medium such that the specific gravity of the submersible varies with pressure and remains substantially equal to the specific gravity of the surrounding medium at the depth of operation.

Figure 3:
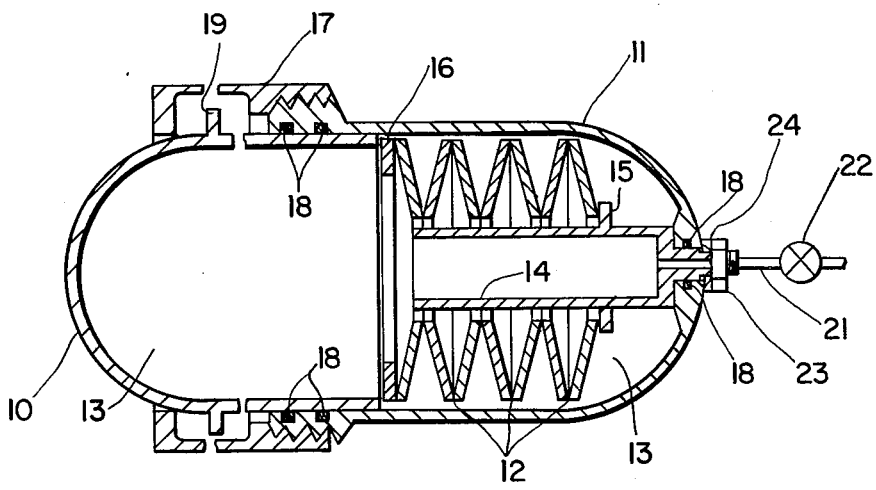
FIG. 3 illustrates a compressible means such as a casing with a spring-fluid backing a movable enclosure.

FIG. 3 illustrates a compressible means including a fixed casing 11 which includes a fluid-spring-backed movable enclosure 10 which has one end extending within the casing and which divides the casing into an open chamber end and a closed chamber end. The movable enclosure is shown as an open-ended cylinder with a semispherical closed end; however it may have any other suitable shape. The movable enclosure 10 is forced outward to its fullest extent by a spring 12, preferably disc-type, and a compressible fluid 13 at normal pressure within the casing and movable enclosure. For the purposes of discussion the compressible fluid will be referred to as air and the surrounding medium as sea water. The spring surrounds a spring guide 14 which is provided with a spring-seat 15 at one end and a cylindrical spacer 16 at the opposite end which mechanically acts between the open-ended cylindrical end of the movable enclosure and the adjacent end of the disc-spring. The surrounding medium is prevented from leakage into the casing and air is prevented from leaking from the casing by suitable O-rings 18 which are seated within the wall of the casing near the end in which the cylindrical end of the movable enclosure extends. The movable enclosure is limited in its outward movement from the casing by use of a collar 17 which is threaded onto the end of the casing. The collar also limits the inward movement of the movable enclosure. The movable enclosure is provided with a cylindrical rib 19 which cooperates with the collar to limit the outward and inward movement of the movable enclosure. The collar and movable enclosure have been shown cut because they may be made any desired length for any desired linear movement of the movable enclosure. The movement of the movable enclosure is controlled by the pressure of the air admitted into the casing and the spring backing the movable enclosure.

The spring is made of spring steel or other metal so that the spring moves in or out in accordance with the water pressure exerted onto the movable enclosure. The spring may be made with a plurality of disc-sections with each section having a different force constant so that each section may be forced together or apart at varying spring ratios under different pressures of water as the submersible moves up or down. As the movable enclosure is moved in or out relative to the casing under varying water pressure due to different depths, water will be added to the area from which the movable enclosure is forced or removed from that area by displacement due to the movable enclosure thereby controlling the specific gravity of the system. The object is to control the density of the system to approximately that of water to reduce or negate propulsive thrust for ascent or descent which may be in the order of thousands of pounds. Each system may have a plurality of such devices to allow for specific gravity changes similar to water density changes over the entire depth range and the movable enclosure device or other specific gravity equalyzers will be placed such that the effect of the change of the submersible's (or other devices) displacement will minimize motion and changes in the center of gravity and center of buoyancy so as to reduce the effect on the floatation units trim.

Figure 5:
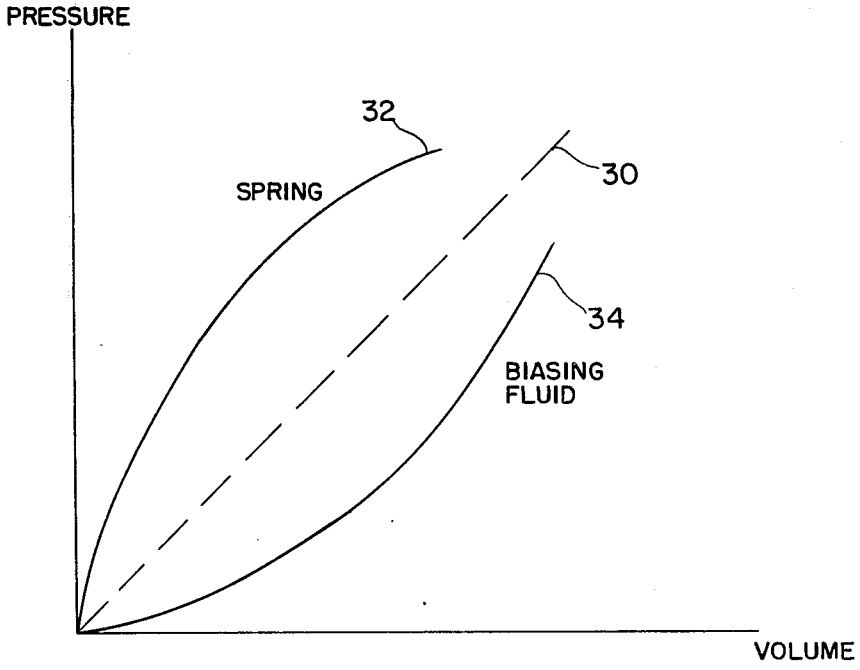
FIG. 5 is a curve showing the pressure versus volume characteristics of a disc-spring and pressurized air in a compressible container.

FIG. 5 illustrates typical pressure-volume characteristics for a spring 32 and pressurized air 34 in a container. The spring characteristics are selected to linearize the characteristic of the pressurized air and provide a roughly linear overall characteristic 30 for a particular container over a selected depth range. The initial pressure of the pressurized biasing fluid in the container (also called "normal pressure" herein) would be equal to the pressure of the external fluid medium in which the submersible vessel is immersed at the topmost depth in the range—that is, if the container were designed for the 1000 to 2000 foot depth range, the normal pressure would be equal to the fluid-medium pressure at the 1000 foot depth. The overall pressure-depth curve 30 is similar to the pressure-depth curve of the fluid medium in which the submersible vessel is immersed so that the volume changes of the compressible container match those in the fluid medium.

In the device shown in FIG. 3, air may be added to the casing through inlet 21 which may be controlled by valve 22. The air is added to a desired pressure (the normal pressure) and then the valve is closed to maintain this pressure. Once the desired pressure has been added to the enclosure the inlet may be sealed or closed and the enclosure used on a submersible as then assembled.

The spring guide is made with an end portion extending through the casing and secured in place by a nut 23 and washer 24 on the outside of the casing. To prevent leakage, an O-ring 18 is provided to seal the passage between the spring guide and the casing. The inlet tube is threaded into the end of the spring guide.

Figure 4:
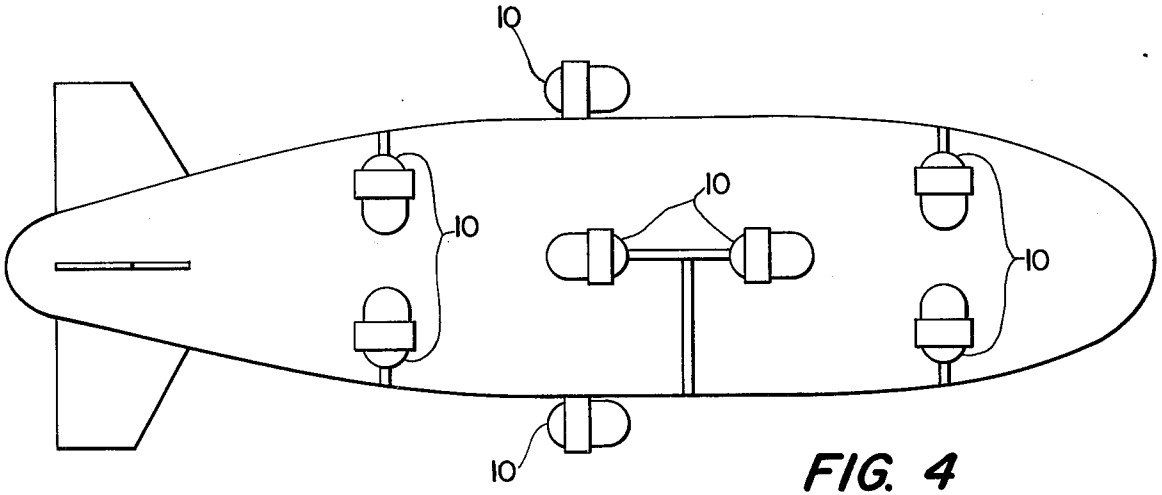
FIG. 4 illustrates a submersible vessel with a plurality of compressible means such as shown in FIG. 3.

If desired, enclosures such as shown in FIG. 3 may be placed on or in the body of a submersible as shown in FIG. 4. In order to allow for emergency siutations necessary to ascend from a submerged condition, two or more of the enclosures may be connected with a stored pressurized air supply whereby air may be added to the enclosure in order to force from the enclosure the water which has been admitted by inward movement of the movable enclosure due to the pressure of the surrounding water. The added air will overcome the pressure of the surrounding water thereby forcing the movable enclosure outward and giving the submersible more buoyancy so that it will surface. Otherwise the devices are unattended.

In carrying out this invention, compressible means are loaded to their normal pressure so that they will overcome a specific water pressure so that different compressible means will collapse a portion thereof at specific depths in the surrounding medium. Thus, the submersible vessel may be controlled and the specific gravity of the submersible will remain substantially that of the surrounding medium. In some cases, some of the compressible means may be forced inwardly to their maximum before others are forced in any distance. Thus the specific gravity may be controlled over a large range of pressures.

In operation of a submarine or other submersible, it will be necessary to provide a plurality of the above-described compressible means. These compressible means as shown in FIG. 3 may be made to operate under a range of different pressures by increasing the air pressure behind the movable enclosure or by varying the size and compression strength of the springs behind the movable closure or both. It is noted that the movable enclosure is permitted to move a certain distance within the housing. The different spring-loaded pistons may be made such that one or two pistons move their full distances before the next ones move any distance. Thus, more water may be taken on as the submersible goes deeper; on the other hand, less water will be within the body as the submersible rises. Of course the submersible depends on motive power to drive the vehicle so that it will go down deeper or rise toward the surface. However, the system could be used on non-powered submersibles if desired.

In case of the loss of power in a submersible emergency, means may be used to expel some water to permit the submersible to rise to the surface. Such emergency means may be a compressed bottle of air from which air may be added to the air-backing pressure behind the movable enclosure thereby overcoming the pressure of the water on the outside of the movable enclosure. Mechanical hand-operated means may be used to force one or two movable enclosures outwardly forcing the water from the casing thereby making the submersible more buoyant. Once the submersible starts upwardly, the submersible will continue upwardly and water will be removed from the casings as the submersible rises due to less pressure of the outer water on the pistons.

The number of weight compressible container mechanisms secured within the body of a submersible depends on the size of the vehicle and the depth of operation.

Obviously many modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. A system for maintaining the specific gravity of a submersible vessel at approximately the same specific gravity at any depth as the specific gravity of the fluid medium in which the vessel is immersed comprising:

a plurality of fluid-activated means carried in said vessel, each fluid-activated means comprising:

a casing, movable enclosure means mounted at one end of and within said casing, said movable enclosure means having a cylindrical end and a semispherical end, said semi spherical end exposed to pressures of said fluid medium with said cylindrical end lying within said casing and forming with said casing a closed chamber, a fluid in said closed chamber at normal pressure, biasing means within said closed chamber for acting against said movable enclosure means to cause it to oppose an inward pressure of said fluid medium, the normal pressure in some of the fluid-activated means being different for operation of said fluid-activated means at different pressure levels of the surrounding medium so that, when the depth of the fluid medium is divided into a series of consecutive depth ranges, the biasing means in each fluid-activated means will exhibit a pressure vs volume characteristic which is roughly the same as the pressure vs volume characteristic of the external fluid medium over the range of depths for which the container is designed, fluid-sealing means mounted to seal against passage of fluid along the contact area between said casing and said movable enclosure means so that none of the fluid medium can enter into said closed chamber and fluid under pressure cannot leak from said closed chamber, the pressure in said fluid medium, when it is higher than the pressure in said closed chamber, acting to force the movable enclosure means inward to proportionately decrease the volume of the closed chamber so as to increase the vessel's specific gravity, and the pressure in said chamber when it is higher than the pressure in said fluid medium, acting to force the movable enclosure means outward to proportionately increase the volume of the closed chamber so as to decrease the vessel's specific gravity.

2. A system as claimed in claim 1 in which:

one or more pairs of first fluid-activated means operable at different pressure levels of the surrounding medium are at the same fluid backing pressure; and one or more pairs of second fluid-activated means operable at different pressure levels of the surrounding medium are at different fluid backing pressure than said one or more pairs of first fluid-activated means.

3. A specific gravity equalizer system which comprises:

a plurality of pressure-collapsible means secured in an object and subjected to the same pressure of a surrounding medium as said object which pressure changes the volume of said pressure-collapsible means in proportion to the pressure of said medium, each of said pressure-collapsible means including a cylindrical casing closed on one end; and a movable cylindrical enclosure with a semispherical end with said movable enclosure fitting within said casing and movable relative thereto with the semispherical end subjected to the pressure of said surrounding medium;

a spring within said casing for applying a spring-force on said cylindrical enclosure;

a compressible fluid under pressure confined by said closed end of said cylindrical casing and said semispherical end of said movable cylindrical enclosure, said spring and compressible fluid backing said movable cylindrical enclosure between said closed end of said casing and said cylindrical enclosure;

stop-limiting means attached to said cylindrical casing; and stop-limiting means on said casing and said movable cylindrical enclosure for restricting the extreme limits of the range or the inward and outward movement of the movable cylindrical enclosure.

4. A specific gravity equalizer system as claimed in claim 3 which comprises:

a fluid seal means between said casing and said movable enclosure to prevent leakage of any fluids between said casing and said movable enclosure.

5. Pressure-collapsible means for use as a specific gravity adjuster comprising:

a casing having a closed end and an open end, an enclosure within said casing movable in an axial direction and separating said casing into an open chamber end and a closed chamber end, a portion of said enclosure being exposed to the outside ambiance and said enclosure movable in response to the pressure of an outside medium on said enclosure so that the volume of said open chamber end varies in response to pressure of said outside medium on said movable enclosure;

biasing means located within said closed chamber for moving said movable enclosure to a position at which the volume of said closed chamber end is greatest and for resisting movement of said movable enclosure in a direction which decreases the volume of said enclosed chamber;

means permitting said open and enclosed chambers to be filled with fluid;

a quantity of fluid within said enclosed chamber at a preselected pressure, whereby the specific gravity is automatically adjusted by varying pressure of the surrounding medium due to the admission of the surrounding medium to the open chamber end and removal of the surrounding medium from the open chamber resulting from a change in the pressure of the surrounding fluid.

6. A pressure-collapsible means as in claim 5, wherein:

said biasing means has a pressure vs volume (p-v) characteristic which is oppositely curved to the p-v characteristic of the fluid within said closed chamber over a given range of volume of said fluid so that the combined p-v curve of fluid and biasing means is substantially linear over said given range of volume.

7. A pressure-collapsible means as in claim 6, wherein:

said biasing means includes a movable spacing member abutting said movable enclosure and a biasing member in contact with said spacing member and urging the latter against said movable enclosure.

8. A pressure-collapsible means as in claim 7, further including limiting means for limiting the movements of said movable enclosure in either direction.

9. A pressure-collapsible means as in claim 6, wherein:

said movable enclosure and said casing are cylindrical in shape.

10. A specific gravity equalizer system comprising a plurality of pressure-collapsible (p-c) means as set forth in claim 6, each different p-c means having a substantially linear p-v characteristic over a different range of pressure, the total range of pressure covered by the plurality of p-c means extending continuously over a desired range of pressure.

11. A specific gravity equalizer system comprising a plurality of pressure-collapsible (p-c) means as set forth in claim 6, the additive p-v characteristic of the plurality p-c means extending continuously over a desired range of pressure, although one or more of the individual p-c means may have a p-v characteristic extending over the same pressure range.

* * * * *